US005718818A

United States Patent [19]

Martyak et al.

[11] Patent Number: 5,718,818

[45] Date of Patent: Feb. 17, 1998

[54] HIGH CURRENT DENSITY ZINC SULFATE ELECTROGALVANIZING PROCESS AND COMPOSITION

[75] Inventors: Nicholas M. Martyak, Doyletown, Pa.; John E. McCaskie, Bedminster, N.J.

[73] Assignee: Atotech USA, Inc., N.Y.

[21] Appl. No.: 754,381

[22] Filed: Nov. 21, 1996

Related U.S. Application Data

[63] Continuation of Ser. No. 388,844, Feb. 15, 1995, abandoned.

[51] Int. Cl.[6] ..... C25D 3/22; C25D 3/24

[52] U.S. Cl. ..... 205/305; 205/308; 205/311; 205/313; 205/314

[58] Field of Search ..... 205/244, 245, 205/246, 305, 308, 311, 313, 314

[56] References Cited

U.S. PATENT DOCUMENTS

| | | | |
|---|---|---|---|
| 3,537,959 | 11/1970 | Korpiun et al. | 205/313 |
| 3,878,069 | 4/1975 | Todt et al. | 205/311 |
| 3,957,595 | 5/1976 | DuBrow et al. | 205/309 |
| 3,960,677 | 6/1976 | Hildering et al. | 205/313 |
| 4,137,133 | 1/1979 | Arcilesi | 205/311 |
| 4,379,738 | 4/1983 | Kohl | 205/311 |
| 4,416,787 | 11/1983 | Marshall et al. | 252/8.8 |
| 4,512,856 | 4/1985 | Paneccasio | 205/314 |
| 4,515,663 | 5/1985 | Strom et al. | 205/245 |
| 4,543,166 | 9/1985 | Lash | 205/246 |
| 4,581,110 | 4/1986 | Tsuchida et al. | 205/245 |
| 4,762,522 | 8/1988 | Maue | 8/94.19 R |
| 4,797,183 | 1/1989 | Yamamoto et al. | 205/50 |
| 4,877,497 | 10/1989 | Watanabe et al. | 205/311 |
| 4,997,471 | 3/1991 | Mente | 71/65 |
| 5,200,057 | 4/1993 | Canaris | 205/245 |

FOREIGN PATENT DOCUMENTS

| | | |
|---|---|---|
| 83/02290 | 7/1983 | WIPO . |

*Primary Examiner*—Kathryn L. Gorgos
*Assistant Examiner*—Edna Wong
*Attorney, Agent, or Firm*—Finnegan, Henderson, Farabow, Garrett & Dunner, L.L.P.

[57] ABSTRACT

A high current density electrogalvanizing process and composition are disclosed for reducing high current density dendrite formation and edge burn and controlling high current density roughness, grain size and orientation of a zinc coating obtained from a zinc sulfate aqueous acidic electrogalvanic coating bath. The composition comprises a high molecular weight polyoxyalkylene glycol grain refining agent in combination with a sulfonated condensation product of naphthalene and formaldehyde which is used as an antidendritic agent.

12 Claims, No Drawings

HIGH CURRENT DENSITY ZINC SULFATE ELECTROGALVANIZING PROCESS AND COMPOSITION

This is a continuation of application Ser. No. 08/338,844, filed Feb. 15, 1995 now abandoned.

BACKGROUND OF THE INVENTION

1. Field of the Invention

The field of the invention is a composition of matter used as an additive to high current density zinc sulfate electroplating baths, and processes utilizing such composition for reducing high current density dendrite formation and edge burn, controlling high current density roughness, grain size, and crystallographic orientation of a zinc coating obtained from the bath.

2. Description of Related Art

Zinc corrosion resistant coatings which are applied electrolytically on ferrous metals such as steel are used extensively in industries where corrosion resistance is required, such as in the automotive industry.

Zinc offers sacrificial protection to ferrous metals because it is anodic to the substrate which is protected so long as some zinc remains in the area to be protected. The presence of minor pin holes or discontinuities in the deposit is of little significance. Zinc is plated continuously in most industrial processes such as the electrogalvanic coating of continuous steel substrates employed in the automotive and tubular steel industries. Acid chloride and sulfate baths are used extensively because they are capable of higher plating speeds than cyanide baths.

They have also displaced cyanide baths because of EPA regulations requiring the reduction or elimination of cyanide in effluents. The chloride baths include neutral chloride baths containing ammonium ions and chelating agents and acid chloride baths having a pH of from about 3.0 to about 5.5 that substitute potassium ions for the ammonium ions used in the neutral baths. Acid baths have largely replaced neutral ones in practice.

The ASTM specification for zinc deposits on ferrous metals call for thicknesses of from about 5 to about 25 μm, depending on the severity of the expected service. ASTMB633-78, Specification For Electrodeposited Coatings Of Zinc On Iron and Steel.

Zinc is deposited from aqueous solutions by virtue of a high hydrogen over voltage since hydrogen would be preferentially deposited under equilibrium conditions.

Typical plating tanks employed in these processes contain anywhere from about 5,000 to about 300,000 gallons and can be employed for plating either zinc or a zinc alloy such as a zinc-nickel alloy. These are continuous plating baths which will accommodate steel rolls about 8 feet in diameter at speeds of anywhere from about 200 to about 850 feet per minute with varying coating weights of from about 20 to about 80 grams/m$^2$ and coating thicknesses from about 6 to about 10 μm. The solution flow rate is approximately 0.5–5 m/sec.

The steel is drawn over conductive rolls and is pressed against the roll to provide adequate contact. Soluble zinc or insoluble iridium oxide coated titanium anodes are immersed in the baths adjacent the coating rolls. In the case of zinc-nickel alloy plating operations, nickel carbonate is added to the system. Anode current density varies in accord with cathode current density.

Excess buildup of zinc at high current densities, however, can occur. If a relatively narrow steel strip is being coated, there may be excess anodes in the system. It is impossible to remove the excess anodes because the next strip to be coated may be larger in size. Because of the mechanics of the line, it is too cumbersome to remove and add anodes to accommodate the size of the different substrates being plated. Current densities of about 50 to about 100 A/dm$^2$ (400–1,000 ASF) are employed which also contribute to the excessive buildup of zinc on the edge of the steel substrate. Allowances for such high current density plating are made by adjusting the solution conductivity, providing close anode cathode spacing, and providing a high solution flow rate.

Another major concern is that high current density [HCD] produces roughness in the form of dendrites at the edge of the steel strip that is being coated. These dendritic deposits may break off during plating or rinsing. As the electrogalvanized steel is passed over rollers, these loose dendrites become embedded across the coated substrate and subsequently show up as blemishes which are referred to as zinc pickups. The edges of the steel strip that are coated are also non-uniform in thickness, and burned because of HCD processing. Additionally, HCD processes can cause roughness across the width of the steel strip and change the grain size and crystallographic orientation of the zinc coating. Nonetheless, HCD processes are industrially desirable since production speed is directly related to current density i.e., higher coating line speeds can be obtained at higher current densities.

Accordingly, various grain refiners [GR] and antidendritic agents [ADA] are employed to partially offset these problems. Nonetheless, the problems of edge roughness, non-uniform thickness, and edge burn have not been completely overcome and as a result, most industrial processes require that the edges be trimmed from the steel strip after it is coated. Diamond knives are presently used to trim the edges. Other mechanical means may also be employed to remove excess zinc buildup. The GR and ADA additives also do not completely eliminate problems with HCD roughness, grain size and orientation of the zinc coating.

It has been found with some of the standard GR or ADA materials that the steel strips exhibit considerable HCD burning at lower additive concentrations whereas nodularity or HCD roughness is still seen at higher concentrations.

The surface roughness of the coated steel strip is expressed in "Ra" units whereas the degree of roughness is expressed in "PPI" units or peaks per inch. These parameters are important in that surface roughness promotes paint adhesion and proper PPI values promote retention of oil which is important during forming operations for zinc coated steel that is used in the manufacture of automobile parts or other parts that are subsequently press formed. A rule of thumb is that the Ra and PPI values should be close to that of the substrate. In some instances it is better to have a zinc coating that is rougher than the substrate rather than smoother and vice versa. Accordingly, the Ra value generally should not be less than or exceed 20% of the Ra value for the substrate dependent upon the desired finish and generally should not exceed about 40 micro inches. The PPI value should be anywhere from about 150 to about 225. Additionally, it has been found that of the various crystallographic orientations of the electrodeposited zinc [(002), (110), (102), (100), (101), and (103)] better results are obtained with a randomly oriented deposit.

As noted, production speed can be increased as current density increases and where current densities presently being employed by industry are at about 1,000 ASF (110

A/dm$^2$) current densities of anywhere from about 1,500 to about 3,000 ASF are being explored in order to obtain higher production rates. Operating at these higher current densities has resulted in unacceptable edge burn, dendritic formation and break off, grain size, problems with obtaining or retention of a given orientation, and unacceptable values for surface roughness.

Additionally, many of the additives to the plating bath employed at about 1,000 ASF do not adequately address the foregoing difficulties.

Pilavov, Russian Patent 1,606,539 describes weekly acidic baths for electrogalvanizing steel containing a condensation copolymer of formaldehyde and 1,5- and 1,8-aminonaphthylalenesulfonic acid prepared in monoethanolamine. The galvanized steel shows a smaller decrease in ductility compared to that obtained from a conventional bath.

Watanabe et al., U.S. Pat. No. 4,877,497 describe an acidic aqueous electrogalvanizing solution containing zinc chloride, ammonium chloride or potassium chloride and a saturated carboxylic acid sodium or potassium salt. The composition inhibits production of anode sludge.

Tsuchida et al., U.S. Pat. No. 4,581,110 describe a method for electroplating a zinc-iron alloy from an alkaline bath containing iron solubilized with a chelating agent.

Strom et al., U.S. Pat. No. 4,515,663 disclose an aqueous acid electroplating solution for depositing zinc and zinc alloys which contains a comparatively low concentration of boric acid and a polyhydroxy additive containing at least three hydroxyl groups and at least four carbon atoms.

Paneccasio, U.S. Pat. No. 4,512,856 discloses zinc plating solutions and methods utilizing ethoxylated/propoxylated polyhydric alcohols as a novel grain-refining agent.

Kohl, U.S. Pat. No. 4,379,738 discloses a composition for electroplating zinc from a bath containing antidendritic additives based on phthalic anhydride derived compounds and analogs thereof in combination with polyethoxyalkylphenols.

Arcilesi, U.S. Pat. No. 4,137,133 discloses an acid zinc electroplating process and composition containing as cooperating additives, at least one bath soluble substituted or unsubstituted polyether, at least one aliphatic unsaturated acid containing an aromatic or heteroaromatic group and at least one aromatic or N-heteroaromatic aldehyde.

Hildering et al., U.S. Pat. No. 3,960,677 describe an acid zinc electroplating bath which includes a carboxy terminated anionic wetting agent and a heterocyclic brightener compound based on furans, thiophenes and thiazoles.

Dubrow et al., U.S. Pat. No. 3,957,595 describe zinc electroplating baths which contain a polyquaternary ammonium salt and a monomeric quaternary salt to improve throwing power.

SUMMARY OF INVENTION

Accordingly, the present invention is directed to a process and composition that substantially obviates one or more of these and other problems due to limitations and disadvantages of the related art.

These and other advantages are obtained according to the present invention which is the provision of a process and composition of matter that substantially obviates one or more of the limitations and disadvantages of the described prior processes and compositions of matter.

Additional features and advantages of the invention will be set forth in the description which follows, and in part will be apparent from the description, or may be learned by practice of the invention. The objectives and other advantages of the invention will be realized and obtained by the process and composition of matter, particularly pointed out in the written description and claims hereof.

To achieve these and other advantages and in accordance with the purpose of the invention, as embodied and broadly described, the invention comprises a high current density electrogalvanizing process and composition of matter for reducing high current density dendrite formation and edge burn and controlling high current density roughness, grain size and orientation of a zinc coating obtained from a zinc sulfate aqueous acidic electrogalvanic coating bath. The process is conducted by adding to the bath a composition of matter comprising a high molecular weight polyoxyalkylene glycol and a sulfonated condensation product of naphthalene and formaldehyde which acts as an antidendritic agent. A current is passed from a zinc anode in the bath to a metal cathode in the bath for a period of time sufficient to deposit a zinc coating on the cathode. High current density of HCD as referred to in this aspect of the invention is intended to include currents from about 50 to about 4,000 ASF or higher or from about 100 to about 3,500 ASF, or from about 300 to about 3000 ASF and especially about 1,000 to about 3,000 ASF.

DETAILED DESCRIPTION

The zinc sulfate electrogalvanic coating baths that may be employed with the compositions of, and according to the processes of the present invention generally comprise a mixture of anywhere from about 0.4 to about 2.0 moles, and especially from about 1.2 to about 1.7 moles of zinc sulfate per liter of solution and from about 0.25 to about 1.5 moles and especially from about 0.75 to about 1.25 moles per liter of solution of an alkali metal salt based on one of the sulfur acids described hereinafter. The alkali metal may be any one of the Group IA metals or mixtures thereof and particularly sodium or potassium and preferably potassium.

The pH of the bath may be anywhere from about 1.2 to about 3.2 and especially from about 1.5 to about 2.2. Sulfur acids may be added to the bath in order to adjust the pH. These acids are well known in the art and include inter alia sulfuric, sulfurous, oleum, thiosulfuric, dithionous, metasulfuric, dithionic, pyrosulfuric, or persulfuric acid and the like as well as mixtures thereof and especially the two component or three component mixtures. Sulfuric acid is preferred because of its commercial availability.

The bath is operated at a temperature of from about 100° F. to about 170° F., and especially from about 120° F. to about 150° F.

The electrogalvanizing process is carried out under conditions and in the manner heretofore described for coating a metal substrate and especially a steel substrate by passing a current from a zinc anode immersed in the electrogalvanic coating bath to a metal cathode in the bath for a period of time sufficient to deposit a zinc coating on the cathode.

The composition of matter of the invention is added to the bath for reducing high current density dendrite formation and edge burn and controlling high current density roughness, grain size and orientation of the zinc coating obtained.

The composition of matter comprises a high molecular weight polyoxyalkylene glycol used as a grain refining agent, and a sulfonated condensation product of naphthalene and formaldehyde which is used as an antidendritic agent.

The high molecular weight polyoxyalkylene glycol is employed in an amount anywhere from about 0.025 to about 1.0 gms/liter and especially from about 0.05 to about 0.2 gms/liter. High molecular weight polyoxyalkylene glycols are intended to include those having a molecular weight of from about 2,000 to about 9,500 and especially from about 6,500 to about 9,000.

The sulfonated condensation product of naphthalene and formaldehyde used as an antidendritic agent is employed in an amount anywhere from about 0.025 to about 1.0 gms/liter and especially from about 0.05 to about 0.2 gms/liter.

The ratios of the high molecular weight polyoxyalkylene glycol to the sulfonated condensation product of naphthalene and formaldehyde is anywhere from about 1.5:1 to about 1:1.5 and especially from about 1.2:1 to about 1:1.2.

The foregoing quantities comprise the quantities of the various components of the composition of matter prior to their addition to the electrogalvanic coating bath. When this composition of matter is added to this coating bath, it is preferably added as a solution or dispersion in a liquid, preferably water, so that the composition is present in the coating bath in an amount from about 50 to about 200 ppm and especially from about 75 to about 125 ppm based on the molar amount of zinc in the bath.

The glycol compound that is employed is based on the lower alkylene oxides, such as those alkylene oxides having from 2 to about 4 carbon atoms and includes not only the polymers thereof but also the copolymers such as the copolymers of ethylene and propylene oxide and/or butylene oxide. The copolymers may be random or block copolymers, where the repeating units of the block copolymers are heteric, or block, or the various combinations of these repeating units known in the art. Preferably the polyoxyalkylene glycol comprises polyethylene glycol or the various copolymers thereof as noted herein and especially a polyethylene glycol having a molecular weight of from about 2,000 to about 9,500 and preferably a polyethylene glycol having an average molecular weight of about 8,000. These compounds include CARBOWAX® PEG 4000 (molec. wt. 3,000–3,700), PEG 6000 (mol. wt. 6,000–7,000) and PEG 8000 sold by Union Carbide Corporation.

Molecular weight and average molecular weight, as those terms are used herein, are intended to mean weight average molecular weight.

In one embodiment, the polyoxyalkylene glycol is preferably substantially water soluble at operating temperatures and may be a polyoxyalkylene glycol ether all-block, block-heteric, heretic-block or heteric-heteric block copolymer where the alkylene units have from 2 to about 4 carbon atoms and may comprise a surfactant which contains hydrophobic and hydrophilic blocks where each block is based on at least oxyethylene groups or oxypropylene groups or mixtures of these groups. Mixtures of copolymers and homopolymers may also be used, especially the 2 or 3 component mixtures.

Of the various polyether-polyol block-copolymers available, the preferred materials comprise polyoxyalkylene glycol ethers which in the case of surfactants contain hydrophobic and hydrophilic blocks, each block preferably being based on at least oxyethylene groups or oxypropylene groups or mixtures of these groups.

The most common method of obtaining these materials is by reacting an alkylene oxide such as ethylene oxide with a material that contains at least one reactive hydrogen. Alternative routes include the reaction of the active hydrogen material with a preformed polyglycol or the use of ethylene chlorohydrin instead of an alkylene oxide.

The reacting active hydrogen material must contain at least one active hydrogen preferably alcohols, and optionally acids, amides, mercaptans, alkyl phenols and the like. Primary amines can be used as well.

Especially preferred materials are those obtained by block polymerization techniques. By the careful control of monomer feed and reaction conditions, a series of compounds, e.g., surfactants can be prepared in which such characteristics as the hydrophile-lipophile balance (HLB), wetting and foaming power can be closely and reproducibly controlled. The chemical nature of the initial component employed in the formation of the initial polymer block generally determines the classification of the materials. The initial component does not have to be hydrophobic. In the case of surfactants, hydrophobicity will be derived from one of the two polymer blocks. The chemical nature of the initial component in the formation of the first polymer block generally determines the classification of the materials. Typical starting materials or initial components include monohydric alcohols such as methanol, ethanol, propanol, butanol and the like as well as dihydric materials such as glycol, glycerol, higher polyols, ethylene diamine and the like.

The various classes of materials, suitable for practice of this aspect of the present invention that are surfactants have been described by Schmolka in "Non-Ionic Surfactants," Surfactant Science Series Vol. 2, Schick, M. J., Ed. Marcel Dekker, Inc., New York, 1967, Chapter 10 which is incorporated herein by reference.

The first and simplest copolymer is that in which each block is homogeneous, which is to say a single alkylene oxide is used in the monomer feed during each step in the preparation. Such materials are referred to as all-block copolymers. The next classes are termed block-heteric and heteric-block, in which one portion of the molecule is composed of a single alkylene oxide while the other is a mixture of two or more such materials, one of which may be the same as that of the homogeneous block portion of the molecule. In the preparation of such materials, the hetero portion of the molecule will be totally random. The properties of these copolymers will be entirely distinct from those of the pure block copolymers. The other class is that in which both steps in the preparation of the different repeating units involve the addition of mixtures of alkylene oxides and is defined as a heteric-heteric block copolymer.

The block copolymer is typified by a monofunctional starting material such as a monohydric alcohol, acid, mercaptan, secondary amine or N-substituted amides. Such materials can generally be illustrated by the following formula:

$$I-[A_m-B_n]_x$$

where I is the starting material molecule as described before. The A portion is a repeating unit comprising an alkylene oxide unit in which at least one hydrogen may be replaced by an alkyl group or an aryl group, and m is the degree of polymerization which is usually greater than about 6. The B moiety is the other repeating unit such as oxyethylene with n again being the degree of polymerization. The value of x is the functionality of I. Thus, where I is a monofunctional alcohol or amine, x is 1; where I is a polyfunctional starting material such as a diol (e.g., propylene glycol), x is 2 as is the case with the Pluronic® surfactants. Where I is a tetrafunctional starting material such as ethylenediamine, x will be 4 as is the case with Tetronic® surfactants. Preferred copolymers of this type are the polyoxypropylene-polyoxyethylene block copolymers.

Multifunctional starting materials may also be employed to prepare the homogeneous block copolymers.

In the block-heteric and heteric-block materials either A or B will be a mixture of oxides with the remaining block being a homogeneous block. Where the copolymer is a surfactant, one block will be the hydrophobe and the other the hydrophile and either of the two polymeric units will serve as the water solubilizing unit but the characteristics will differ depending on which is employed. Multifunctional starting materials can also be employed in materials of this type.

The heteric-heteric block copolymers are prepared essentially the same way as discussed previously with the major difference being that the monomer feed for the alkylene oxide in each step is composed of a mixture of two or more materials. The blocks will therefore be random copolymers of the monomer feed. In the case of surfactants, the solubility characteristics will be determined by the relative ratios of potentially water soluble and water insoluble materials.

The average molecular weight of the polyoxyalkylene glycol ether block copolymers utilized according to the present invention is from about 2,000 to about 9,500 especially from about 2,000 to about 8,500. The weight ratio of A to B repeating units will also vary from about 0.4:1 to about 2.5:1, especially from about 0.6:1 to about 1.8:1 and preferably from about 0.8:1 to about 1.2:1.

In one embodiment, these copolymers have the general formula:

$$RX(CH_2CH_2O)_nH$$

where R has an average molecular weight of from about 500 to about 8,000 and preferably from about 1,000 to about 6,000 and especially from about 1,200 to about 5,000, and where R is usually a typical surfactant hydrophobic group but may also be a polyether such as a polyoxyethylene group, polyoxypropylene group, polyoxybutylene group or a mixture of these groups. In the above formula X is either oxygen or nitrogen or another functionality capable of linking the polyoxyethylene chain to the hydrophobe. In most cases, n, the average number of oxyethylene units in the repeating unit, must be greater than about 5 or about 6. This is especially the case where it is desired to impart sufficient water solubility to make the materials useful.

The polyoxyalkylene glycol ethers are the preferred non-ionic polyether-polyol block-copolymers. However, other non-ionic block-coplymers useful in the invention can be modified block copolymers using the following as starting materials:

(a) alcohols, (b) fatty acids, (c) alkylphenol derivatives, (d) glycerol and its derivatives, (e) fatty amines, (f)-1, 4-sorbitan derivatives, (g) castor oil and derivatives, and (h) glycol derivatives.

The preferred sulfonated condensation product of naphthalene and formaldehyde used as an antidendritic agent comprises BLANCOL®-N. An equivalent of BLANCOL®-N is TAMOL®-N which is a methoxylated sulfonate.

It has been found that the composition of the invention is especially effective in reducing dendrite formation and edge burn at high current densities, as defined herein and especially at about 1500 to about 3000 ASF.

The composition was evaluated in a plating cell containing a zinc sulfate solution as follows:

Zn 90–100 g/L
CARBOWAX® 8000 0.1 gms/liter
BLANCOL®-N 0.1 gms/liter
pH 1.5; 60° C.; 52 a/dm$^2$ (500 A/F$^2$)
Solution Flow: turbulent The composition of the present invention was added to the zinc sulfate solution in the cell in an amount of 100 ppm of each component of the composition based on the molar amount of Zn present in the solution. No dendrites were formed and significant reduction in edge burn at these coating conditions were observed.

Alloys of zinc may also be deposited employing the above formulation as additives to the coating bath. Nickel alloys are the most common alloys of zinc utilized in zinc-type corrosion protection coatings and the preparation of these type of alloy coatings are also within the scope of the present invention. Any of the other Group VIII metals may be used in this regard besides nickel, and include cobalt. Zinc alloys with Cr or Mn can also be plated. Mixtures of alloying metals from Group VIII and/or Group IIB or Cr or Mn may also be prepared, especially the two component or three component alloys where the alloying metal is present in the coating in an amount anywhere from about 0.1 to about 20 percent by weight and especially from about 5 to about 15 percent by weight.

The alloys are prepared by inserting the alloy metal into the coating baths either as an anode in a manner well known in the art or by adding a salt of the alloying metal to the coating bath.

Although the examples describe the electrogalvanizing process as one that is conducted on a steel substrate, any conductive metal substrate may be employed whether a pure metal or a metal alloy, and include other iron-alloy substrates or metals or alloys based on Groups IB, IIB, IIIA, IVA, IVB, VA, VB, VIB or VIIB, the alloys comprising combinations of two or more of these metals and especially the two or three or four component combinations of metals. The alloying metal is present in the substrate in an amount anywhere from about 0.1 to about 20 percent by weight and especially from about 5 to about 15 percent by weight.

It will be apparent to those skilled in the art that various modifications and variations can be made to the composition and process of the invention without departing from the spirit or scope of the invention. It is intended that these modifications and variations of this invention are to be included as part of the invention, provided they come within the scope of the appended claims and their equivalents.

What is claimed is:

1. A process for reducing dendrite formation and edge burn, and controlling roughness, grain size and orientation of a zinc coating obtained from a zinc sulfate aqueous acidic electrogalvanic coating bath operated at a current density of from about 100 to about 3500 ASF which comprises adding to said bath a composition of matter consisting essentially of:

a glycol compound comprising a polyoxyalkylene glycol homopolymer or copolymer grain refining agent having a molecular weight of from about 2,000 to about 9,500 and a sulfonated condensation product of naphthalene and formaldehyde as an antidendritic agent, and passing from about 100 to about 3500 ASF of current from an anode in said bath to a metal cathode in said bath for a period of time to deposit a zinc coating on said cathode.

2. The process of claim 1, wherein said current density is from about 100 to about 3,000 ASF.

3. The process of claim 1, wherein said glycol compound comprises a random or a block polymer or copolymer of an alkylene oxide having from 2 to about 4 carbon atoms.

4. The process of claim 1, wherein said copolymer is a random or block copolymer or polymer based on ethylene oxide.

5. The process of claim 1, wherein said glycol compound comprises a poly ethylene glycol having a molecular weight of about 2,000 to about 9,500.

6. The process of claim 5, wherein said polyethylene glycol has an average molecular weight of about 8,000.

7. The process of claim 6, wherein said current density is from about 100 to about 3,000 ASF.

8. The process of claim 6, wherein said copolymer is a random or block copolymer or polymer based on ethylene oxide.

9. The process of claim 6, wherein said glycol compound comprises a poly ethylene glycol having a molecular weight of about 2,000 to about 9,500.

10. The process of claim 9, wherein said polyethylene glycol has an average molecular weight of about 8,000.

11. A process for reducing dendrite formation and edge, and controlling roughness, grain size, and orientation of a zinc coating obtained from an electrogalvanic coating bath which comprises passing from about 100 to about 3,500 ASF of current from an anode in said bath to a metal cathode in said bath for a period of time to deposit a zinc coating on said cathode, said bath including:

a zinc sulfate aqueous acidic electrogalvanic coating composition; and a composition of matter consisting essentially of a glycol compound comprising a polyoxyalkylene glycol homopolymer or copolymer grain refining agent having a molecular weight of from about 2,000 to about 9,500 and a sulfonated condensation product of naphthalene and formaldehyde as an antidendritic agent.

12. The process of claim 11, wherein said glycol compound comprises a random or a block polymer or copolymer of an alkylene oxide having from 2 to about 4 carbon atoms.

* * * * *

UNITED STATES PATENT AND TRADEMARK OFFICE

CERTIFICATE OF CORRECTION

PATENT NO. : 5,718,818
DATED : February 17, 1998
INVENTOR(S) : Martyak et al.

It is certified that error appears in the above-indentified patent and that said Letters Patent is hereby corrected as shown below:

Title Page, item [73], in the Assignee, "N.Y." should read --N.J.--.

IN THE CLAIMS:

Claim 5, column 9, line 2, "poly ethylene "should read --polyethylene--.

Claim 9, column 9, line 12, "poly ethylene" should read --polyethylene--.
Claim 11, column 9, line 16, after "edge", insert —burn—

Signed and Sealed this

Twenty-first Day of April, 1998

Bruce Lehman

*Attest:*

BRUCE LEHMAN

*Attesting Officer*

*Commissioner of Patents and Trademarks*